United States Patent [19]

Igarashi

[11] Patent Number: 4,724,430

[45] Date of Patent: Feb. 9, 1988

[54] FIRE DETECTOR

[75] Inventor: Yoshinori Igarashi, Tokyo, Japan

[73] Assignee: Nohmi Bosai Kogyo Co., Ltd., Tokyo, Japan

[21] Appl. No.: 11,063

[22] Filed: Feb. 4, 1987

[30] Foreign Application Priority Data

Feb. 13, 1986 [JP] Japan ..... 61-18208[U]

[51] Int. Cl.[4] ..... G08B 23/00

[52] U.S. Cl. ..... 340/693; 340/630

[58] Field of Search ..... 340/577, 578, 579, 581, 340/583, 588, 589, 594, 628, 629, 630, 632, 633, 634, 693, 691; 250/574

[56] References Cited

U.S. PATENT DOCUMENTS

| | | | |
|---|---|---|---|
| 3,767,917 | 10/1973 | Lampart et al. | 340/629 X |
| 4,092,641 | 5/1978 | Bellinghausen et al. | 340/628 X |
| 4,168,438 | 9/1979 | Morisue | 250/574 |
| 4,315,594 | 2/1982 | Niederöst | 340/693 |
| 4,529,976 | 7/1985 | Jameson et al. | 340/628 |

*Primary Examiner*—Glen R. Swann, III
*Assistant Examiner*—Tat K. Wong
*Attorney, Agent, or Firm*—Amster, Rothstein & Ebenstein

[57] ABSTRACT

A fire detector having a body comprising a cover part and a hood part and containing therein fire detecting means and electrical circuits, and a base detachably fastening the body by engaging means provided on them, respectively, is disclosed wherein in order to prevent the cover part from coming off the hood part due to shock, vibration, etc. possibly subjected thereto at the time of maintenance, inspection, etc. of the detector the cover part is provided on its upper surface with a plurality of vertically projecting posts each having at its upper end a hook member, the hood part being provided on its top wall with a corresponding number of openings each having an engaging portion formed at a part of the upper edge portion of the radially inner peripheral wall to be engaged by the hook members, respectively, and a corresponding number of grooves are provided in the upper surface of the top wall each in communication with a gap formed between radially outer walls of the grooves and the radially outer surface of the projecting post when the hook member engages the engaging portion, and a corresponding number of shifting members are provided on the under surface of the base which are adapted to be shiftably received in the grooves, respectively, to reach the respective gaps formed between the outer peripheral walls of the grooves and the radially outer surfaces of the posts when the engaging means provided in the body engage the engaging means provided in the base.

6 Claims, 6 Drawing Figures

FIRE DETECTOR

BACKGROUND OF THE INVENTION

The present invention relates to a fire detector and more particularly to the construction of the body and the base in the fire detector wherein the body is comprised of a cover part and a hood part and which contains therein fire detecting means and electrical circuits, the base being adapted to detachably fasten the body thereto.

In general, a fire detector comprises a body in which are received fire detecting means to detect the appearance of a fire and electrical circuits to convert the output of the fire detecting means into electrical signals, etc. and a base which is adapted to be installed on the surface of a ceiling, etc. in order to detachably fasten the body to the surface of a ceiling, etc.

In this case, in order to facilitate the cleaning of the fire detecting means and the replacement of the elements of the electrical circuits, etc. during maintenance and inspection of the fire detector the body comprises a cover part which is provided with claw members and a hood part which is provided with stepped portions to be engaged by the claw members.

However, if the body thus comprising a cover part and a hood part is so constituted that they can be easily separated from each other during maintenance and inspection of the fire detector the cover part may be apt to easily come off from the hood part when fastening the body to the base due to the shock, vibrations, etc. to which the body may be possibly subjected, causing problem. Conversely, if the cover part and the hood part are so constituted that it is hard for the cover part to come off even when subjected to shock, vibration, etc. one or both of the cover and the hood parts may be easily damaged, or broken, etc. when it is attempted to disconnect them from each other at the time of maintenance, inspection, etc. of the fire detector, giving rise to other problems.

SUMMARY OF THE INVENTION

Therefore, it is an object of the present invention to provide a fire detector having a body comprising a cover part and a hood part and containing therein fire detecting means and electrical circuits, and a base to detachably fasten the body wherein when the body and the base are in a fastened state the cover part does not come off from the hood part due to any shock, vibration, etc. to which the body may possibly subjected and yet which comes off easily from the hood part at the time of maintenance, inspection, etc. of the fire detector.

In accordance with the present invention a fire detector having a body comprising a cover part and a hood part and containing therein fire detecting means and electrical circuits, and a base for detachably fastening the body by engaging means provided on both the base and body, respectively, wherein in order to prevent the body from coming off the base due to any shock, vibration, etc. to which the body may possibly be subjected the cover part is provided on its upper surface with a plurality of vertically projecting posts each having at its upper end a hook member, the hood part being provided in its top wall with a corresponding number of openings each having a step-like engaging portion to be engaged by the hook members, respectively, at the upper edge portions of the radially inner surfaces thereof and the top wall being provided with a corresponding number of arcuate grooves in the upper surface thereof each in communication with the opening to form a gap between the outer wall of the groove and the radially outer surface of the projecting post when the hook member of the post engages the engaging portion of the opening, a corresponding number of shifting members being provided on the under surface of the base which are adapted to be respectively shiftably received in the grooves, and adapted to reach the respective gaps formed between the outer wall of the groove and the radially outer surface of the projecting post when the engaging means provided in the body engage the engaging means provided in the base as a result of their relative rotation.

Thus, in the fire detector in accordance with the present invention, since the hook members of the posts provided in the cover part are adapted to engage the step-like engaging portions of the radially inner surfaces of the openings provided in the hood part, the connection of the cover part with and its release from the hoood part can, on the one hand, be easily performed while on the other hand, once the cover and the hood parts have been fastened together to constitute the body and the so constituted body has been fastened to the base the shifting members of the base fill in the gaps formed between the outer walls of the grooves and the radially outer surfaces of the projecting posts resulting from the relative rotation of the shifting members within the grooves in the hood part. Therefore, the posts are prevented from coming out of the openings due to any possible shock, vibration, etc. to which they may be subjected. Further, the shifting members on the base and the grooves in the hood part also serve as guides for the body when it is to be fastened to the base.

BRIEF DESCRIPTION OF THE DRAWINGS

Other objects and advantages of the present invention will become more apparent from the following description taken in connection with the accompanying drawings wherein are set forth by way of illustration and example certain embodiments of the present invention.

DESCRIPTION OF THE PREFERRED EMBODIMENT

Figure 1:
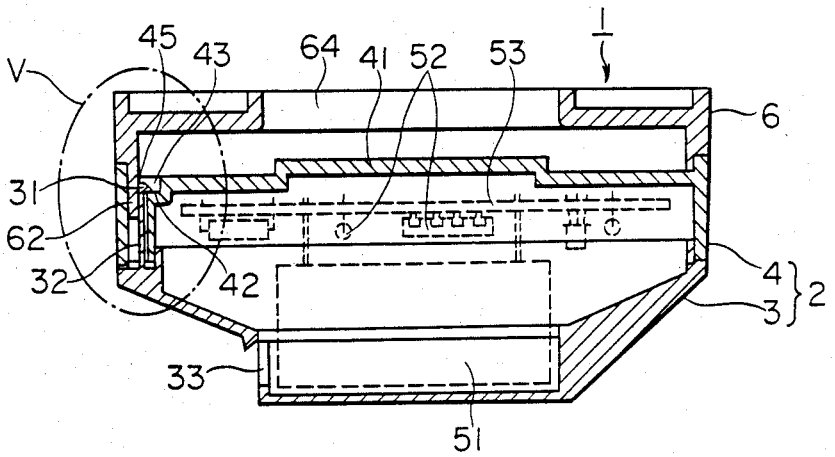
FIG. 1 is a longitudinal cross-sectional view of one embodiment of a fire detector in accordance with the present invention.

Now reference is made to FIG. 1 of the drawings wherein is shown an embodiment of the fire detector in accordance with the present invention at reference numeral 1 which comprises a body 2 comprising a cover part 3 and a hood part 4 and containing therein a printed board 53 on which are mounted fire detecting means 51 such as of the light-scattering type and electrical circuit elements such as a fire descriminating circuit or analogue/digital transducing circuit or the like, and a base 6 adapted to be secured by such as screws to the surface of a ceiling not shown and adapted to have the body 2 detachably fastened thereto when there is a relative rotation between them.

The cover part 3 is provided on its upper surface with a number of vertically projecting posts 32 preferably at regular angular intervals, the upper ends of which are provided with a hook member 31 (See also FIGS. 5 and 6.), while in its lower portion with a number of air inlets 33 for leading smoke to the fire detecting means 51.

The hood part 4 is provided on its top wall 41 with openings 43 having a rectangular cross section in the same number and at the same positions as those of the projecting posts 32 on the cover part 2 (See also FIGS. 5 and 6.), each of the radially inward peripheral walls of the openings having a step-like engaging portion 42 at their upper edge portions to be engaged by the hook members 31, respectively. Mounted below the under surface of the top wall 41 of the hood part 4 is the printed board 53 which mounts the fire detecting means 51, electrical circuit elements 52, etc. and which is connected to blade fixtures 44 provided as engaging means on the upper surface of the top wall 41 through pin terminals not shown.

When the posts 32 provided on the cover part 3 are inserted into the respective openings 43 formed in the hood part 4, respectively, the hook members 31 formed at the free ends of the posts 32 respectively engage the engaging portions 42 formed at the upper edges of the inner peripheral walls of the openings 43 formed in the hood part 4, respectively, whereby the cover part 3 and the hood part 4 are thus engaged together to form the body 2. The cover part 3 can be easily disconnected from the hood part 4 by using the fingers or the pointed objects to move the free ends of the posts 32 to release the engagement between the hook members 31 and the engaging portions 42.

In the upper surface of the top wall 41 of the hood part 4 concentric arcuate grooves 45 are provided in the same number as that of the openings 43, each in communication with the openings to form the respective gaps between the outer peripheral walls of the respective grooves 45 and the radially outer surfaces of the posts 32 when the hook members 31 of the posts 32 engage with the step-like engaging portions 42 formed in the top wall of the hood part 4 at the upper edge portions of the openings 43 of the hood part 4, respectively. See FIG. 5.

Figure 3:
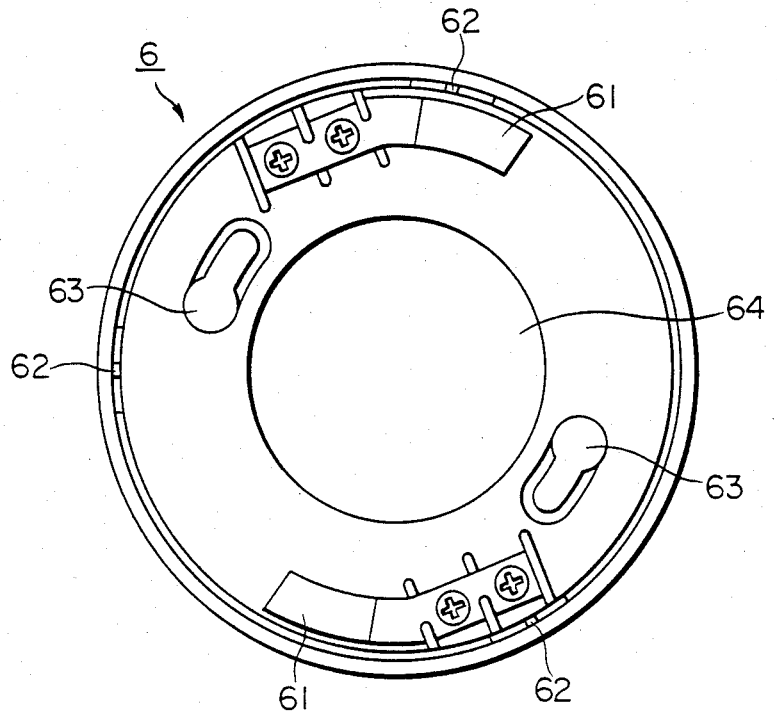
FIG. 3 is a bottom plan view of the base shown in FIG. 1.

As shown in FIG. 3 the base 6 is provided at its under surface with blade receiving fixtures 61 which act as engaging means in cooperation with the blade fixtures 44 to engage the hood part 4, and a corresponding number of shifting members 62, each adapted to be shiftably received in the grooves 45 of the hood part 4, respectively, and adapted to reach and fill the respective gaps that are formed between the outer peripheral walls of the grooves 45 and the radially outer surfaces of the posts 32 when the blade fixtures 44 and the blade receiving fixtures 61 are engaged with each other as a result of the relative rotation between the body 2 and the base 6. See FIG. 5.

The base 6 is adapted to be preliminarily secured to the surface of a ceiling, etc. by such as screws (not shown) passed through the screw-holes 63, and the wires connected to an electrical source and signal wires (not shown) introduced through a bore 64 are connected to the blade receiving fixtures 61.

Figure 4:
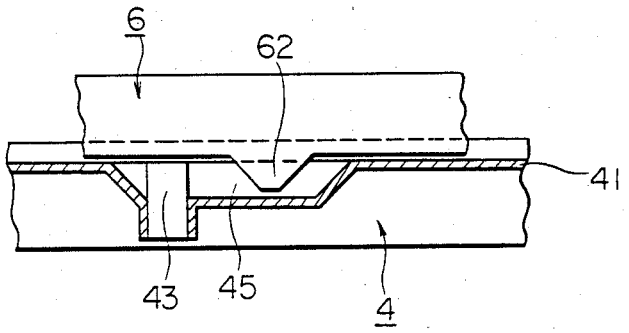
FIG. 4 is a partial view to illustrate the process of engagement between the groove formed in the hood part and the shifting member formed in the base shown in FIGS. 1 and 3 on a larger scale.
Figure 5:
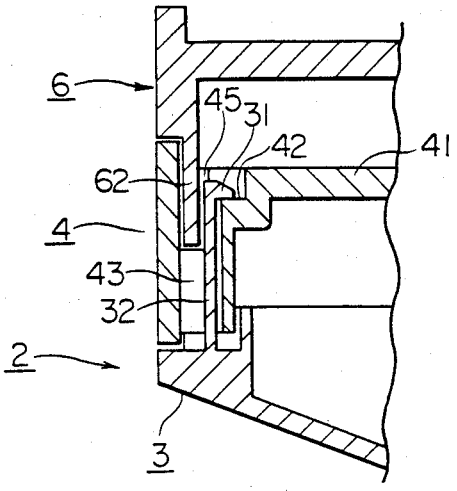
FIG. 5 is an enlarged view of a portion of FIG. 1 encircled by circle V.
Figure 6:
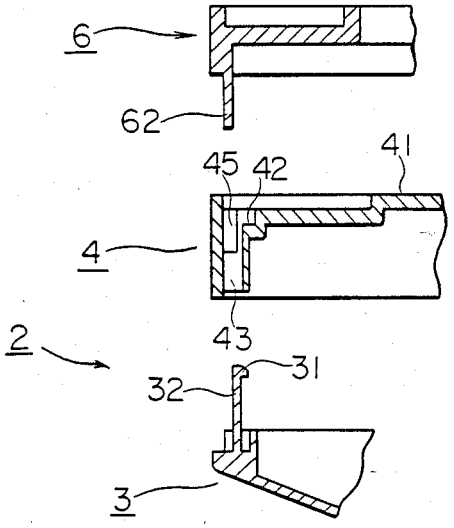
FIG. 6 is an exploded view of FIG. 5.

On assembly, as shown in FIG. 4, when the top wall 41 of the hood part 4 is urged upwards to abut against the lower edges of the shifting members 62 and the body 2 is rotated relative to the base 6 the shifting members 62 are respectively received within the grooves 45 to be shifted until the blade fixtures 44 engage with the respective blade receiving fixtures 61 to stop the further rotation of the body 2. At this state, as shown in FIGS. 1 and 5 the shifting members 62 are respectively inserted into the respective gaps formed between the outer peripheral walls of the grooves 45 and radially outer surfaces of the posts 32. Therefore, as shown in FIG. 5, substantially all of the gaps are filled with the shifting members 62 and the posts 32 are prevented from being moved due to shock, vibration, etc., to thereby securely engage the hook members 31 and the engaging portion 42.

In this case, if the end walls of the grooves 45 and/or the side edges of the shifting members 62 are so shaped that they have sloped surfaces converging downwards the moving of the shifting members 62 into or out of the grooves 45 will be smoother.

Figure 2:
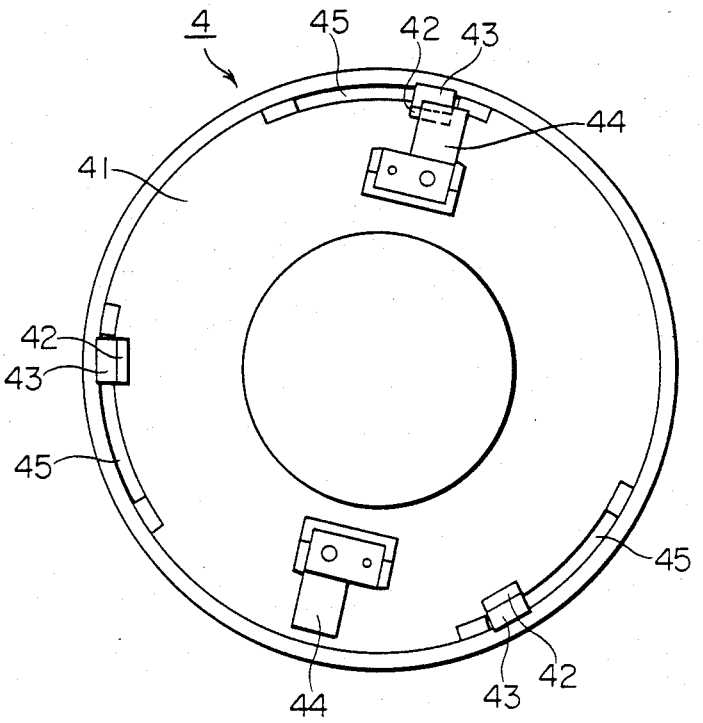
FIG. 2 is a top plan view of the hood part shown in FIG. 1.

If the blade fixtures 44 and the blade receiving fixtures 61 have polarities or there are more than three sets of fixtures, then as shown in FIGS. 2 and 3, the arcuate angles of the grooves 45 and the shifting members 62 relative to the top wall 41 are not identical to each other and the grooves 45 and the shifting members 62 can also serve as guides to surely and correctly engage the blade fixtures 44 with the blade receiving fixtures 61.

The opening 43 is not necessarily shaped so as to have a rectangular cross section, and the engaging portion 42 of the edge portion of the peripheral wall of the opening 43 may be embodied as e.g. a projection at the side edge of the peripheral wall of the opening 43. It is also possible that the grooves 45 are not provided with bottoms, but instead may be constituted as through-holes passing through the top wall 41 of the hood part 4.

Thus, it will be appreciated that according to the present invention an improved fire detector is provided in which the cover part will not come off of the base as a result of shock or vibration when the body is fastened to the base and in which, at the time of maintenance, inspection, etc. of the detector the cover part and the hood part constituting the body can be easily detached from each other, the constitution thereof being extremely simple.

It is to be understood that although certain forms of the present invention have been illustrated and described, it is not limited thereto except insofar as such limitations are included in the following claims:

What is claimed is:

1. A fire detector having a body comprising a cover part and a hood part and containing therein fire detecting means and electrical circuits, and a base detachably fastening said body by engaging means respectively provided on said body and said base, wherein said cover part is provided at its upper surface with a number of vertically projecting posts each having at its upper end a hook member, and said hood part is provided in its top wall with openings in the same number and positions as those of said projecting posts, each of said openings having an engaging portion to be engaged by said hook member formed at the upper edge of their inner periphery or their lateral periphery, said top wall being provided in its upper surface with grooves in the same number as that of said openings, each of said grooves having an arcuate configuration which is adapted to be in communication with said opening to form a gap between the radially outer surface of said projecting post and the outer periphery of said groove when said hook member of said post engages said engaging portion of said opening, said base being provided on its under surface with shifting members in the same number as that of said projecting posts and adapted to be shiftably received in said grooves, respectively, to reach said gap when said engaging means provided in said hood part on said upper surface of said top wall respectively engage said engaging means provided on said base.

2. A fire detector as claimed in claim 1 wherein said opening in said hood part has a rectangular cross section.

3. A fire detector as claimed in claim 1 wherein the end walls of said groove are shaped such that they converge downwards.

4. A fire detector as claimed in claim 1 wherein the side edges of said shifting member of said base are converged downwards.

5. A fire detector as claimed in claim 1 wherein said engaging portion formed in said top wall is shaped as a projection.

6. A fire detector as claimed in claim 1 wherein said groove formed in said top wall of said hood part is shaped as a slot passing through said top wall.

* * * * *